US010650995B2

(12) United States Patent
Ochi et al.

(10) Patent No.: US 10,650,995 B2
(45) Date of Patent: May 12, 2020

(54) VACUUM INTERRUPTER

(71) Applicant: MITSUBISHI ELECTRIC CORPORATION, Chiyoda-ku, Tokyo (JP)

(72) Inventors: Satoshi Ochi, Tokyo (JP); Shinichi Miki, Tokyo (JP); Taiki Donen, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 16/072,766

(22) PCT Filed: Mar. 3, 2017

(86) PCT No.: PCT/JP2017/008423
§ 371 (c)(1),
(2) Date: Jul. 25, 2018

(87) PCT Pub. No.: WO2017/183323
PCT Pub. Date: Oct. 26, 2017

(65) Prior Publication Data

US 2019/0035578 A1 Jan. 31, 2019

(30) Foreign Application Priority Data

Apr. 19, 2016 (JP) ..... 2016-083334

(51) Int. Cl.
*H01H 33/664* (2006.01)
*H01H 1/02* (2006.01)
*H01H 11/04* (2006.01)

(52) U.S. Cl.
CPC ..... *H01H 33/664* (2013.01); *H01H 1/0206* (2013.01); *H01H 11/04* (2013.01); *H01H 33/6643* (2013.01); *H01H 2033/6648* (2013.01)

(58) Field of Classification Search
CPC ..... H01H 1/0206; H01H 33/664; H01H 33/6643; H01H 11/04; H01H 33/6644;
(Continued)

(56) References Cited

U.S. PATENT DOCUMENTS 3,244,843 A * 4/1966 Ross ..... H01H 33/12 200/288
3,469,050 A * 9/1969 Robinson ..... H01H 33/662 200/239
(Continued)

FOREIGN PATENT DOCUMENTS

CH 531 248 A 11/1972
DE 4119191 * 12/1992 ..... H01H 33/664
(Continued)

OTHER PUBLICATIONS

Translation of DE4119191 (original document published Dec. 17, 1992) (Year: 1992).*
(Continued)

*Primary Examiner* — William A Bolton
(74) *Attorney, Agent, or Firm* — Buchanan Ingersoll & Rooney PC

(57) ABSTRACT

A vacuum interrupter includes a fixed side contact and a movable side contact; a fixed side electrode rod connected to the fixed side contact; a movable side electrode rod connected to the movable side contact; a fixed side reinforcement plate which is arranged between the fixed side electrode rod and the fixed side contact, and whose rim portion has a step portion to be arranged apart from the back of the
(Continued)

fixed side contact; and a movable side reinforcement plate which is arranged between the movable side electrode rod and the movable side contact, and whose rim portion has a step portion to be arranged apart from the back of the movable side contact.

19 Claims, 7 Drawing Sheets

(58) Field of Classification Search
CPC ... H01H 33/6645; H01H 33/6646; H01H 9/30
USPC ..... 218/118, 123, 127, 146
See application file for complete search history.

(56) References Cited

U.S. PATENT DOCUMENTS 4,210,790 A * 7/1980 Kurosawa ..... H01H 33/6644 218/127
4,588,879 A * 5/1986 Noda ..... H01H 33/6644 218/127
4,926,017 A * 5/1990 Aoki ..... H01H 33/666 218/123
6,479,778 B1 11/2002 Kimura et al.
6,506,992 B2 * 1/2003 Kim ..... H01H 33/6644 218/123
8,039,771 B2 10/2011 Trondsen
8,779,317 B2 * 7/2014 Kim ..... H01H 33/664 218/118
2009/0184274 A1 7/2009 Kikuchi et al.
2012/0091101 A1 4/2012 Kim

FOREIGN PATENT DOCUMENTS

JP 50-086678 U 7/1975
JP 3812711 B2 8/2006
JP 2009170372 A 7/2009
JP 2014127280 A 7/2014
WO 2011104751 A1 9/2011

OTHER PUBLICATIONS

International Search Report (PCT/ISA/210) dated Jun. 6, 2017, by the Japanese Patent Office as the International Searching Authority for International Application No. PCT/JP2017/008423.
Extended European Search Report dated Feb. 13, 2019, issued by the European Patent Office in corresponding European Application No. 17785666.3. (10 pages).

* cited by examiner

VACUUM INTERRUPTER

TECHNICAL FIELD

The present invention relates to a vacuum interrupter for use in, for example, a vacuum circuit breaker.

BACKGROUND ART

FIG. 9 is a sectional view in which a contact portion in a conventional vacuum interrupter is enlarged. This contact 1 is arranged in a vacuum vessel and is formed with a plurality of spiral grooves, each of which smoothly changes its direction from a center portion to a rim portion. In this drawing, a reinforcement plate 5 and a spacer 8 are arranged on the back of the contact 1; and an electrode rod 6 is joined to the contact 1 via the reinforcement plate 5 and the spacer 8.

In such a spiral shaped contact 1, when fault current is interrupted, current flows along the contact 1 machined in the spiral shape and thereby generating a magnetic field in a radial direction, and a concentrated arc due to the fault current generated between the contacts 1 is driven in a circumferential direction by the magnetic field, whereby the arc is prevented from remaining in a certain place of the contact 1 and interruption performance is improved. The reinforcement plate 5 prevents metallic vapor or the like generated between the contacts 1 during the interruption of fault current from dispersing to the backside of the contact 1, from attaching to the inner surface of ceramics, and from degrading withstand voltage performance.

Furthermore, generally, contact pressure is exerted between the contacts 1 in a contact closed state; and force exceeding the contact pressure is further temporarily generated at a moment when the contacts 1 collide during contact closing operation, a lot of stress is generated in the contact 1, and the contact 1 is likely to be deformed. The reinforcement plate 5 also combines the role of reinforcing so that the contact 1 does not deform by being arranged on the backside of the contact 1 while coming in contact with the contact 1.

Material such as stainless steel, which is stronger in strength and higher in resistance than the contact 1, is generally used for material of the reinforcement plate 5; however, current is shunted to the reinforcement plate 5 according to the resistance ratio between the contact 1 and the reinforcement plate 5. The spiral shaped groove is not formed in the reinforcement plate 5; and accordingly, a magnetic field is not generated from the current that flows through the reinforcement plate 5, the magnetic field generated from the contact 1 is reduced by the amount of current that flows through the reinforcement plate 5 and it causes to degrade the interruption performance.

For example, if the structure is such that a contact does not come in contact with a reinforcement plate behind the contact as in U.S. Pat. No. 8,039,771, current that flows through the reinforcement plate disappears and a magnetic field generated from the contact increases, but a function serving as the reinforcement of the contact also disappears and the contact is more likely to be deformed.

More particularly, in the case of a contact for use at a high contact pressure and a shape in which a recess at a central portion of the contact is large and which comes in contact at a rim portion as in JP,3812711,B, a problem exists in that deformation of the contact increases and adoption of such a structure is difficult.

RELATED ART DOCUMENT

Patent Document

Patent Document 1: U.S. Pat. No. 8,039,771
Patent Document 2: JP,3812711,B

SUMMARY OF THE INVENTION

Problems to be Solved by the Invention

In the aforementioned conventional vacuum interrupter, the reinforcement plate is arranged on the back of the contact and comes in contact with the entire surface of the contact in order to reinforce the contact; and accordingly, problems exist in that current during the interruption of fault current flows through not only the contact but also the reinforcement plate, the magnetic field due to the current that flows through the contact is reduced, and the interruption performance is degraded.

The present invention has been made to solve the above described problem, and an object of the present invention is to improve interruption performance and a further object is to provide a vacuum interrupter which can also reinforce a contact.

Means for Solving the Problems

According to the present invention, there is provided a vacuum interrupter including: a fixed side contact and a movable side contact, each of which is arranged in a vacuum vessel to be able to connect and disconnect, has a contact portion to be connected to and disconnected from each other, and is formed with a plurality of arc shaped grooves from a center portion to a rim portion; a fixed side electrode rod connected to the fixed side contact; a movable side electrode rod connected to the movable side contact; a fixed side reinforcement plate which is arranged between the fixed side electrode rod and the fixed side contact, and whose rim portion has a step portion to be arranged apart from the back of the fixed side contact; and a movable side reinforcement plate which is arranged between the movable side electrode rod and the movable side contact, and whose rim portion has a step portion to be arranged apart from the back of the movable side contact.

Furthermore, according to the present invention, there is provided a vacuum interrupter including: a fixed side contact and a movable side contact, each of which is arranged in a vacuum vessel to be able to connect and disconnect, has a contact portion to be connected to and disconnected from each other, and is formed with a plurality of arc shaped grooves from a center portion to a rim portion; a fixed side electrode rod connected to the fixed side contact; a movable side electrode rod connected to the movable side contact; a fixed side projection portion provided in a central portion on the back side of the fixed side contact; a movable side projection portion provided in a central portion on the back side of the movable side contact; a fixed side reinforcement plate which is arranged between the fixed side electrode rod and the fixed side contact, whose central portion comes in contact with the fixed side projection portion, and whose rim portion has a step portion to be arranged apart from the back of the fixed side contact; and a movable side reinforcement plate which is arranged between the movable side electrode rod and the movable side contact, whose central portion comes in contact with the movable side projection portion, and whose rim portion has a step portion to be arranged apart from the back of the movable side contact.

Advantageous Effect of the Invention

According to the vacuum interrupter according to the present invention, the reinforcement plate which is arranged between the fixed side electrode rod and the fixed side contact, and whose rim portion has the step portion to be arranged apart from the back of the fixed side contact; and the reinforcement plate which is arranged between the movable side electrode rod and the movable side contact, and whose rim portion has the step portion to be arranged apart from the back of the movable side contact are provided, whereby, each step portion of the reinforcement plate does not come in contact with the fixed side contact and the movable side contact and therefore there can be obtained the vacuum interrupter that can improve interruption performance of the vacuum interrupter while maintaining the strength of a contact portion.

MODE FOR CARRYING OUT THE INVENTION

Embodiment 1

Figure 1:
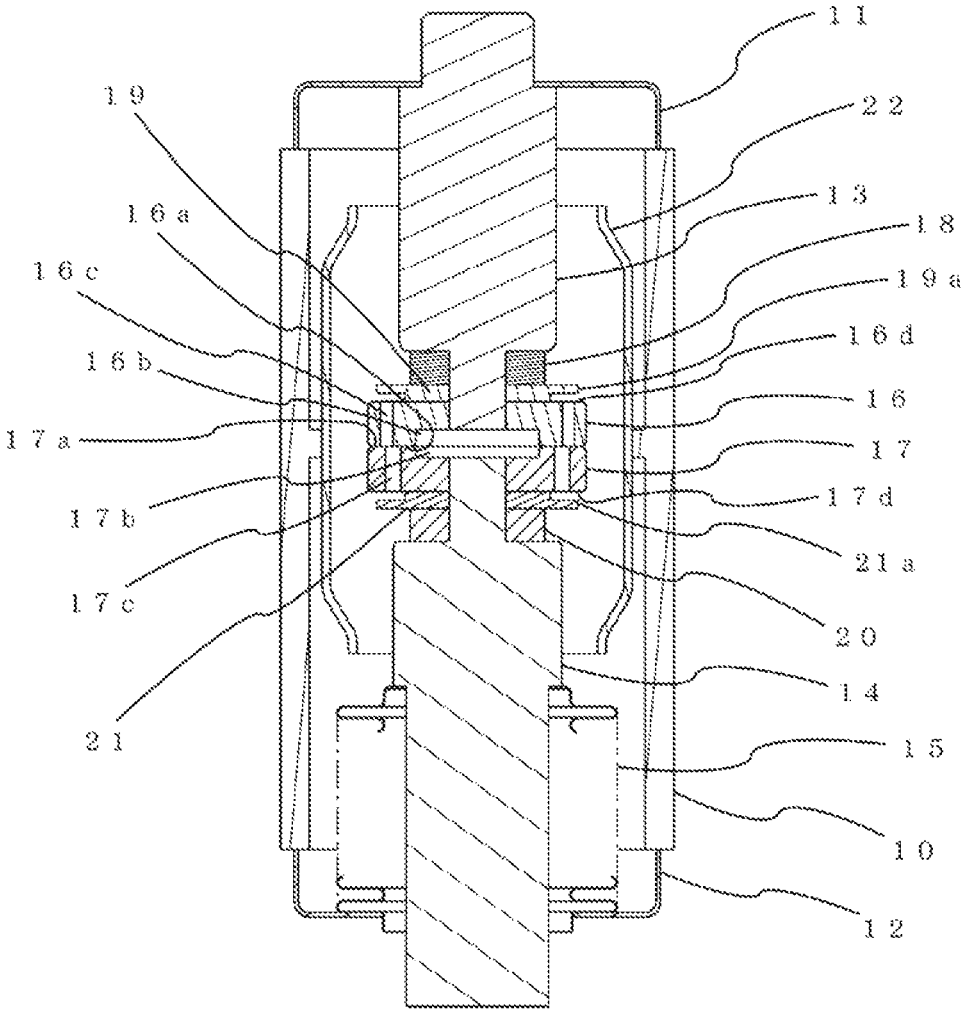
FIG. 1 is a sectional view showing a vacuum interrupter according to Embodiment 1 of the present invention.
Figure 2:
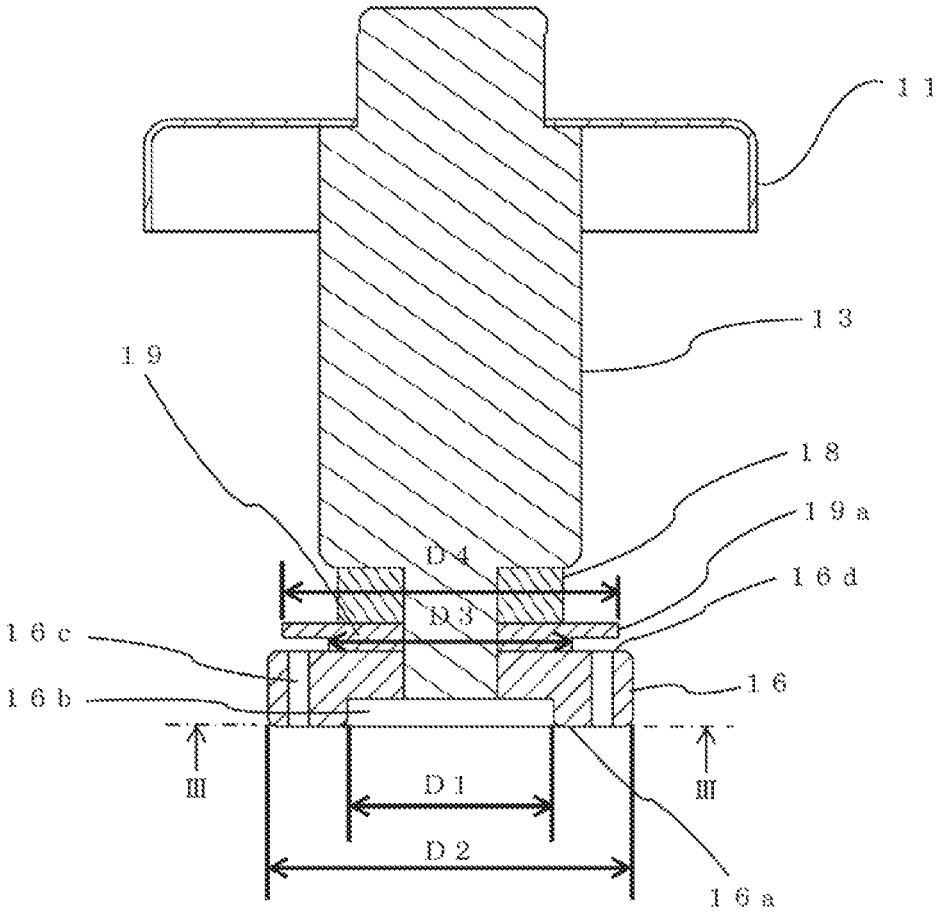
FIG. 2 is a sectional view showing a contact portion of the vacuum interrupter according to Embodiment 1 of the present invention.
Figure 3:
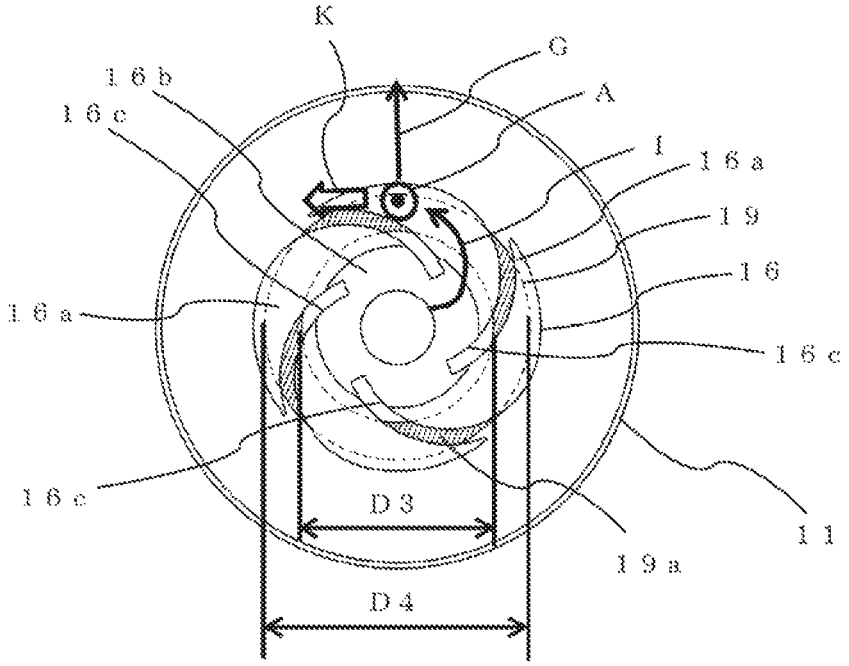
FIG. 3 is a sectional view taken along the line III-III of FIG. 2 showing the vacuum interrupter according to Embodiment 1 of the present invention.
Figure 4:
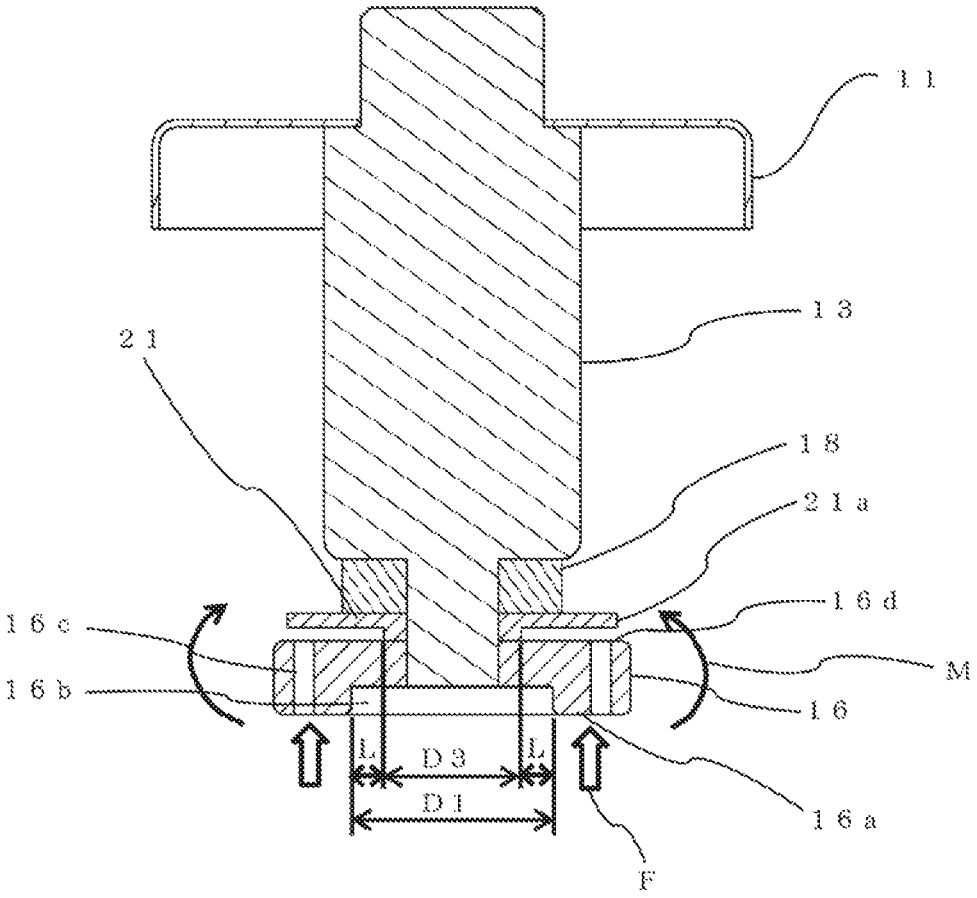
FIG. 4 is a sectional view showing comparison of the moment to be exerted on the contact portion in the vacuum interrupter according to Embodiment 1 of the present invention.

Hereinafter, Embodiment 1 of the present invention will be described based on FIG. 1 to FIG. 4. Then, in each of the drawings, identical or equivalent members and portions will be described with the same reference numerals (and letters) assigned thereto. FIG. 1 is a sectional view showing a vacuum interrupter according to Embodiment 1 of the present invention. FIG. 2 is a sectional view showing a contact portion of the vacuum interrupter according to Embodiment 1 of the present invention. FIG. 3 is a sectional view taken along the line III-III of FIG. 2 showing the vacuum interrupter according to Embodiment 1 of the present invention. FIG. 4 is a sectional view showing comparison of the moment to be exerted on the contact portion in the vacuum interrupter according to Embodiment 1 of the present invention.

In these drawings, a reference numeral 10 denotes a vacuum vessel of the vacuum interrupter and, for example, the vacuum vessel is made of ceramics. 11 denotes a fixed side flange attached to the fixed side of the vacuum vessel 10; 12 denotes a movable side flange attached to the movable side of the vacuum vessel 10; 13 denotes a fixed side electrode rod which is supported to the fixed side flange 11 and is arranged in the vacuum vessel 10; 14 denotes a movable side electrode rod which can pass through the movable side flange 12, is arranged in the vacuum vessel 10, and is coaxially arranged with the fixed side electrode rod 13; and 15 denotes an accordion shaped bellows made of thin metal which is coupled to the movable side electrode rod 14 and the movable side flange 12 and allows the movable side electrode rod 14 to be movable while the interior of the vacuum vessel 10 of the vacuum interrupter is kept vacuum.

16 denotes a fixed side contact which is attached to the tip of the fixed side electrode rod 13 and has a contact portion 16*a*; and although not shown in the drawing, 17 denotes a movable side contact to be connected to and disconnected from the fixed side contact 16, the movable side contact 17 being attached to the tip of the movable side electrode rod 14 and having a contact portion to be brought into contact with the contact portion 16*a*. A concave shaped spiral portion 16*b* is formed in a center portion on the contact portion 16*a* side of the fixed side contact 16 and arc shaped grooves 16*c* are formed from the spiral portion 16*b* toward the rim portion, what is called, a spiral shaped fixed side electrode is constituted.

Furthermore, also in the movable side contact 17, similarly to the fixed side contact 16, a concave shaped spiral portion 17*b* is formed in a center portion on the contact portion 17*a* of the movable side contact 17 and arc shaped grooves 17*c* are formed from the spiral portion 17*b* toward the rim portion, what is called, a spiral shaped movable side electrode is configured.

18 denotes a spacer arranged between the fixed side electrode rod 13 and the fixed side contact 16; and 19 denotes a reinforcement plate arranged between the spacer 18 and the fixed side contact 16 and a configuration is such that a rim portion of the reinforcement plate 19 has a step portion 19*a* separated from the back 16*d* of the fixed side contact 16. More specifically, the configuration is such that the thickness of a central portion of the reinforcement 19 is thickened, the step portion 19*a* of the reinforcement 19 is thinned than the thickness of the central portion, and the step portion 19*a* is arranged apart from the back 16*d* of the fixed side contact 16.

20 denotes a spacer arranged between the movable side electrode rod 14 and the movable side contact 17; 21 denotes a reinforcement plate arranged between the spacer 20 and the movable side contact 17 and a configuration is such that a rim portion of the reinforcement plate 21 has a step portion 21*a* separated from the back 17*d* of the movable side contact 17. More specifically, the configuration is such that the thickness of a central portion of the reinforcement 21 is thickened, the step portion 21*a* of the reinforcement 21 is thinned than the thickness of the central portion, and the step portion 21*a* is arranged apart from the back 17*d* of the movable side contact 17.

Incidentally, 22 denotes a shield which is attached inside the vacuum vessel 10 and is arranged over the fixed side contact 16 and the movable side contact 17. Then, the shield 22 prevents metallic vapor, which is diffused from an arc that is ignited between the fixed side contact 16 and the movable side contact 17, from attaching to an inner wall of the vacuum vessel 10.

During energization, the movable side contact 17 is contact closed by an operating mechanism of a circuit breaker (not shown in the drawing) and is pressurized by a contact pressure spring (not shown in the drawing); and when fault current is generated, the movable side contact 17 moves the movable side electrode rod 14 to a contact opened position by the operating mechanism to interrupt large current. After the fixed side contact 16 is separated from the movable side contact 17, the arc is generated between the fixed side contact 16 and the movable side contact 17; however, if the current exceeds approximately 10 kA, the arc is concentrated at one place and becomes a concentrated arc A.

At this time, the spiral shaped groove 16*c* is formed in the fixed side contact 16 and the spiral shaped groove 17*c* is formed in the movable side contact 17, the current flows along the shape of the spiral and thereby generating a magnetic field G, and the concentrated arc A is made to rotate and move without being remained at one place by the magnetic field G and arc driving force K by current I, whereby local overheat of the fixed side contact 16 and the movable side contact 17 is suppressed and interruption performance is improved.

For example, although a description will be made on the fixed side contact 16 side, as shown in FIG. 2, the step portion 19*a* with thin thickness in which the reinforcement plate 19 is separated from the back 16*d* of the rim portion of the fixed side contact 16 is provided and a diameter D3 of a portion in which the reinforcement 19 comes in contact with the fixed side contact 16 is set larger than an inner diameter D1 of a thick portion of the rim portion of the fixed side contact 16. More specifically, the configuration is such that the thickness of the central portion of the reinforcement 19 is thickened, the step portion 19*a* of the reinforcement 19 is thinned than the thickness of the central portion, and the step portion 19*a* is arranged apart from the back 16*d* of the fixed side contact 16. Then, material of the fixed side contact 16 is, for example, a composite material of copper and chromium and the reinforcement plate 19 is made of, for example, stainless steel.

For example, as shown in FIG. 4, when a diameter D3 of a portion in which the reinforcement 21 comes in contact with the fixed side contact 16 is smaller than the inner diameter D1 of the thick portion of the rim portion of the fixed side contact 16, axial force F is applied to the thick portion of the rim portion of the fixed side contact 16 by contact pressure of the fixed side contact 16 or impact during contact closing; however, a support does not exist on the back of the thick portion and thus the axial force F is supported by the diameter D3 of the portion in which the reinforcement 21 comes in contact with the fixed side contact 16 on the back of the thin portion of the fixed side contact 16.

At this time, the moment M depending on the length of L=(D1−D3)/2 is generated on a contact thin portion L of the fixed side contact 16 in a direction shown in FIG. 4. A lot of stress is generated in the thin portion with low strength of the fixed side contact 16 by the moment M during the contact closing and possibility of generating deformation and/or damage of the fixed side contact 16 is increased by a large number of opening or closing operations.

However, in this Embodiment 1, the diameter D3 of the portion in which the reinforcement 19 comes in contact with the fixed side contact 16 is increased than the inner diameter D1 of the thick portion of the rim portion of the fixed side contact 16, whereby the backside of the thin portion of the fixed side contact 16 can be supported, the moment exerted on the thin portion of the fixed side contact 16 is extremely reduced, and the deformation and/or damage of the fixed side contact 16 can be prevented.

Furthermore, in the spiral shaped contact, the current I flows along the facing spiral shape and thereby generating the magnetic field Gin a radial direction; and as shown in FIG. 3, the arc driving force K is generated by the concentrated arc A and the magnetic field G and the concentrated arc A is driven along the circumference of the fixed side contact 16; however, the strength of the magnetic field G is strengthened in proportion to the current I that flows through this spiral shape and the arc driving force K also tends to increase.

Figure 9:
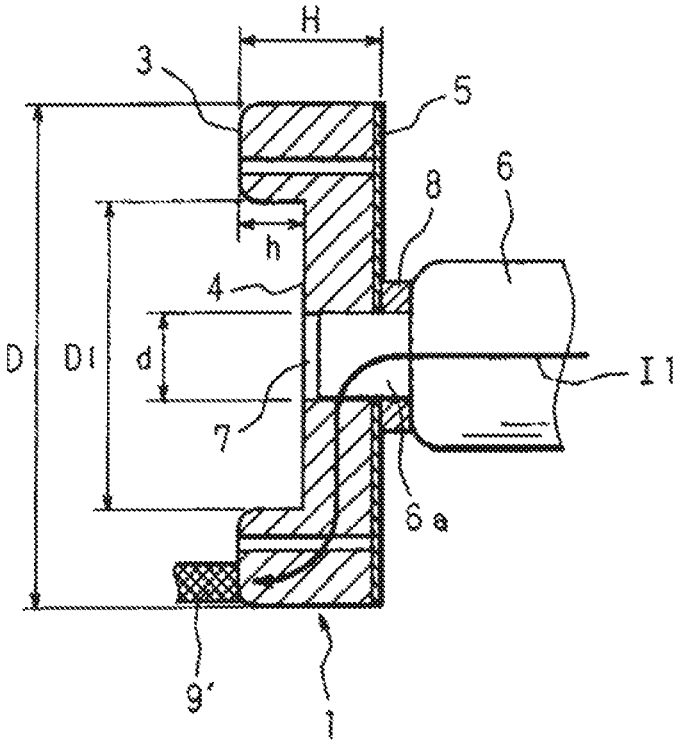
FIG. 9 is a sectional view showing a contact portion in a conventional vacuum interrupter.

In the conventional structure shown in FIG. 9, the reinforcement plate 5 comes in contact with the entire surface of the back of the contact 1 and the current is shunted to the reinforcement plate 5. Since the spiral shaped groove is not formed in the reinforcement plate 5, the current shunted to the reinforcement plate 5 does not flow through the spiral shape and thus the magnetic field cannot be generated. Furthermore, the current that flows through the spiral shape of the contact is also reduced by the amount of current that flows through the reinforcement plate 5; and accordingly, the magnetic field to be generated is reduced.

In the vacuum interrupter according to this Embodiment 1, as shown in FIG. 2 and FIG. 3, since the step portion 19*a* of the reinforcement plate 19 does not come in contact with the fixed side contact 16 in an area on the outer diameter side than the diameter D3 of the portion in which the reinforcement 19 comes in contact with the fixed side contact 16, all the current flows through the fixed side contact 16. Furthermore, since the groove is not formed in the conventional reinforcement plate, current flows. However, the current does not flow through a hatching portion of the step portion 19*a* of the reinforcement plate 19 shown in FIG. 3; and therefore, magnetic field strength of the fixed side contact 16 is improved by approximately 20% than ever before and the interruption performance is improved by approximately 10%.

As for an inner portion of the diameter D1 of the fixed side contact 16, the fixed side contact 16 comes in contact with the reinforcement plate 19, the current is shunted to the reinforcement plate 19 and the current that flows along the spiral shape is reduced, and the magnetic field is reduced; however, the arc moves to the rim portion by electromagnetic force immediately after arc generation and begins to rotate on the rim portion; and therefore, the influence on the interruption performance is small. More particularly, as for the shape like JP,3812711,B in which the contact portion is positioned in the rim portion, the generation of the arc is limited to the contact portion of the rim portion and thus the influence to be exerted on the interruption performance by a magnetic field at a portion within the diameter D1 is imperceptible.

If the diameter D3 of the portion in which the reinforcement 19 comes in contact with the fixed side contact 16 is increased, an effect as the reinforcement of the fixed side contact 16 increases; however, the magnetic field tends to reduce by an increase in current that flows through the reinforcement plate 19 at the same time and, if the diameter D3 reaches an outer circumferential diameter D2 of the fixed side contact 16, the magnetic field strength becomes the same as that of the conventional structure.

Consequently, the diameter D3 of the portion in which the reinforcement 19 comes in contact with the fixed side contact 16 needs to be smaller than the outer circumferential diameter D2 of the fixed side contact 16. Preferably, a range of D1<D3<(D1+D2)/2 has a profound effect and is effective for an improvement in magnetic field strength. Furthermore, in order not to bring the fixed side contact 16 into contact with the reinforcement plate 19, it is preferable that a level difference is equal to or more than 0.5 mm.

When the large current is interrupted, the metallic vapor generated between the fixed side contact 16 and the movable side contact 17 by the arc is dispersed in the axial direction through the groove 16*c* of the spiral shaped fixed side contact 16 and is dispersed to the inside or the like of the vacuum vessel 10 made of ceramics in the vacuum interrupter and the withstand voltage performance is degraded; however, the reinforcement plate 19 has the role of blocking the metallic vapor dispersed from the groove 16*c* of the fixed side contact 16 and preventing the degradation of the withstand voltage performance.

The larger the outer diameter D4 of the reinforcement 19 is, the larger the interruption effect is; however, if the outer diameter D4 is larger than the outer circumferential diameter D2 of the fixed side contact 16, field strength at the tip of the reinforcement plate 19 is increased and the withstand voltage performance is degraded; and thus, it is desirable that the outer diameter D4 is smaller than the outer circumferential diameter D2 of the fixed side contact 16.

The reinforcement plate 19 and the fixed side contact 16 are generally joined by a method such as blazing; however, if temperature in brazing is too high, brazing material between the reinforcement plate 19 and the fixed side contact 16 may creep up near the surface of the contact. However, if the brazing material is present adjacent to the surface of the contact, the brazing material is melted by the arc during the interruption of large current and the interruption performance may be degraded; and thus, control of blazing temperature becomes important.

In the shape of this Embodiment 1, area in which the fixed side contact 16 is blazed to the reinforcement plate 19 is small in the back 16*d* of the fixed side contact 16, the amount of the brazing material can be reduced, the brazing material can be difficult to creep up adjacent to the surface of the contact even when the brazing temperature is high, the temperature control in brazing becomes easy, and an effect can also be obtained that the vacuum interrupter with higher reliability can be easily manufactured.

In the aforementioned FIG. 2 and FIG. 3, the description has been made on the fixed side electrode rod 13, the fixed side contact 16, and the reinforcement plate 19; however, although not shown in the drawings, the movable side electrode rod 14, the movable side contact 17, and the reinforcement plate 21 are also the same configuration and the same effects can be exhibited.

Embodiment 2

Figure 5:
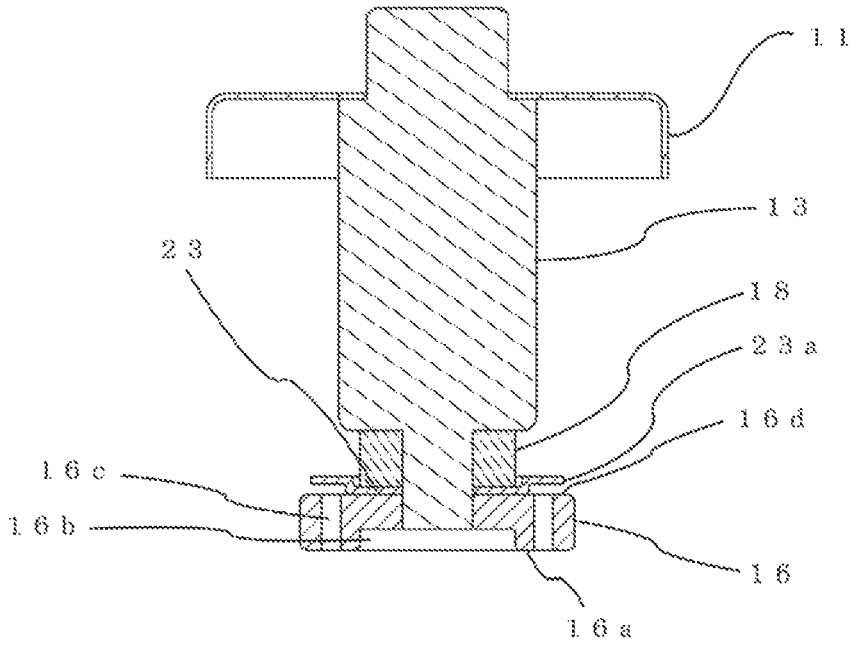
FIG. 5 is a sectional view showing a contact portion in a vacuum interrupter according to Embodiment 2 of the present invention.

Embodiment 2 of the present invention will be described based on FIG. 5. FIG. 5 is a sectional view showing a contact portion in a vacuum interrupter according to Embodiment 2 of the present invention.

In a shape shown in FIG. 5 in Embodiment 2 of the present invention, the shape of a reinforcement plate 23 is a shape in which a thin plate is bent. More specifically, a central portion of the thin plate-shaped reinforcement plate 23 is formed into a concave shaped portion by, for example, press working to serve as a portion that comes in contact with a fixed side contact 16, whereby a step portion 23*a* in which a rim portion of the reinforcement plate 23 is separated from the back 16*d* of the fixed side contact 16 can be configured, and it can be configured into a substantially equivalent shape to that of the aforementioned Embodiment 1. Also in the shape such as this, effects similar to those of the above-mentioned Embodiments 1 can be obtained; and since the reinforcement plate 23 can be manufactured by the press working, there can be obtained an effect that can be manufactured more inexpensively.

Embodiment 3

Figure 6:
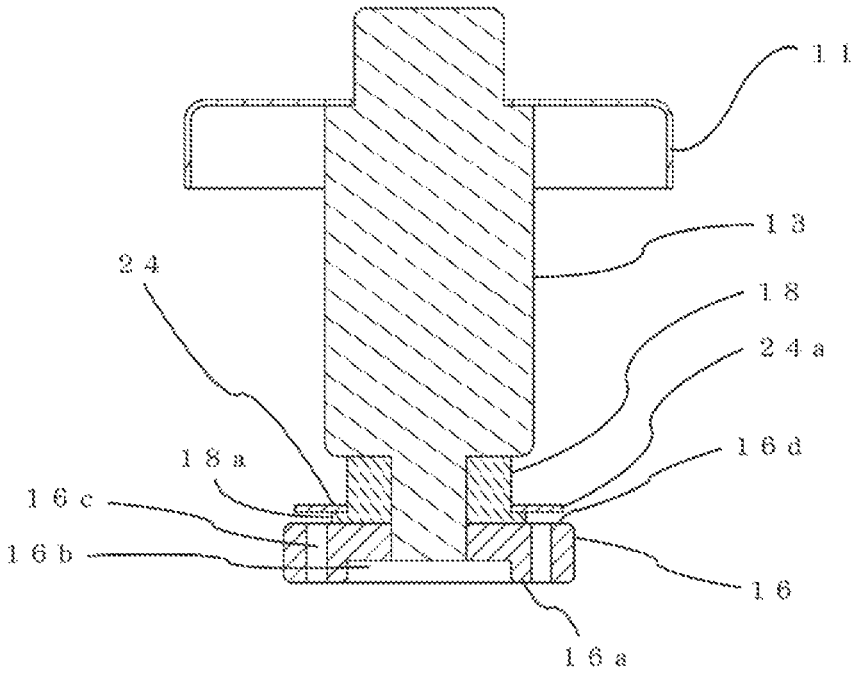
FIG. 6 is a sectional view showing a contact portion in a vacuum interrupter according to Embodiment 3 of the present invention.

Embodiment 3 of the present invention will be described based on FIG. 6. FIG. 6 is a sectional view showing a vacuum interrupter according to Embodiment 3 of the present invention.

In a shape shown in FIG. 6 in Embodiment 3 of the present invention, a spacer 18 formed with a step portion 18*a* in a rim portion thereof on the fixed side contact 16 side is arranged between a fixed side electrode rod 13 and a fixed side contact 16, and a fixed side reinforcement plate 24 is attached to the step portion 18*a* of the spacer 18, whereby a step portion 24*a* separated from the back 16*d* of the fixed side contact 16 can be configured in a rim portion of the fixed side reinforcement plate 24 and effects similar to those of the aforementioned respective embodiments can be exhibited.

Incidentally, if the spacer 18 and the fixed side reinforcement plate 24 are made as an integrated structure, the number of components can be further reduced and there can be obtained an effect that can be manufactured more inexpensively.

Embodiment 4

Figure 7:
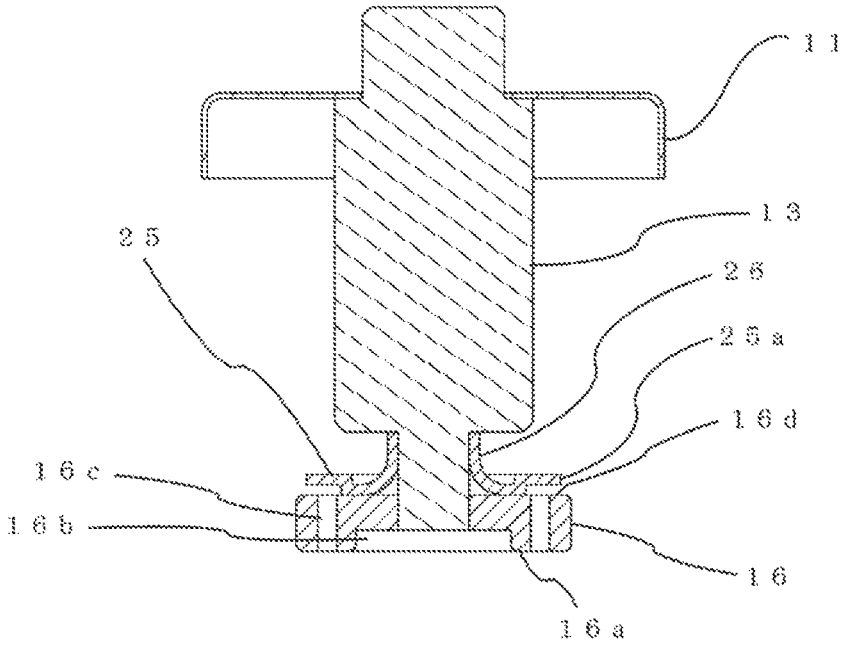
FIG. 7 is a sectional view showing a contact portion in a vacuum interrupter according to Embodiment 4 of the present invention.

Embodiment 4 of the present invention will be described based on FIG. 7. FIG. 7 is a sectional view showing a contact portion in a vacuum interrupter according to Embodiment 4 of the present invention.

The shape of a fixed side reinforcement plate 25 shown in FIG. 7 in this Embodiment 4 is a shape in which a stainless steel thin plate is bent, a rim portion of the fixed side reinforcement plate 25 constitutes a step portion 25*a* separated from the back 16*d* of a fixed side contact 16, and the fixed side reinforcement plate 25 is integrally structured with a spacer 26. Although the spacer 26 has the role of supporting the fixed side reinforcement plate 25, the fixed side reinforcement plate 25 is bent in an axial direction to have a positioning function by fitting to the diameter of a fixed side electrode rod 13.

This allows the fixed side reinforcement plate 25 to be manufactured by press working and a reduction in the number of components and a reduction in cost can be achieved at the same time. Furthermore, effects regarding the improvement in interruption performance and the reinforcement of the fixed side contact 16 in the aforementioned Embodiment 1 can also be similarly obtained.

Embodiment 5

Figure 8:
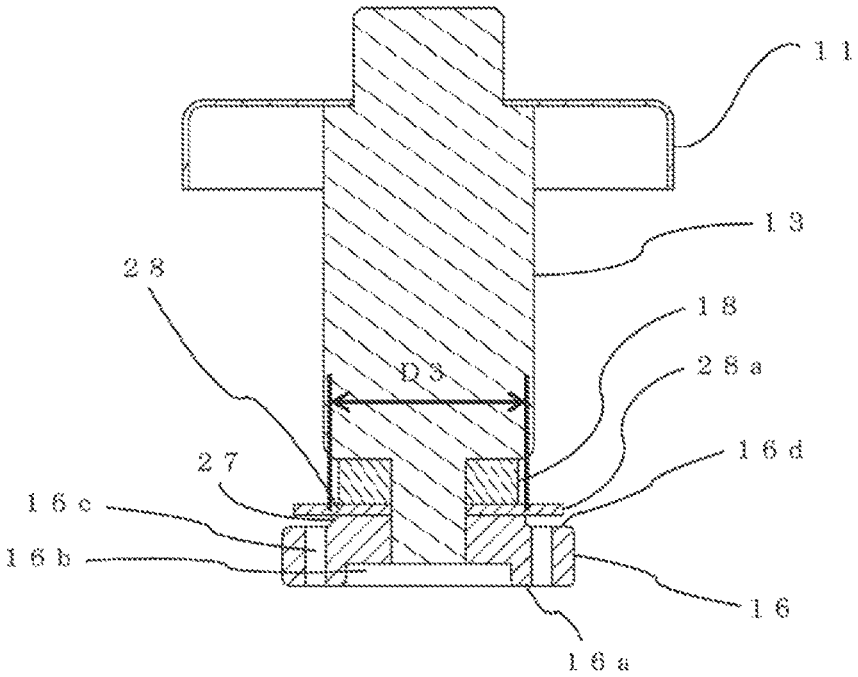
FIG. 8 is a sectional view showing a contact portion in a vacuum interrupter according to Embodiment 5 of the present invention.

Embodiment 5 of the present invention will be described based on FIG. 8. FIG. 8 is a sectional view showing a contact portion in a vacuum interrupter according to Embodiment 5 of the present invention.

In the shape of FIG. 8 in Embodiment 5 of the present invention, a configuration is such that a fixed side projection portion 27 is provided in a central portion on the back side of a fixed side contact 16, a central portion of a fixed side reinforcement plate 28 comes in contact with the fixed side projection portion 27 on the fixed side of the contact 16, and a rim portion of the fixed side reinforcement plate 28 has a step portion 28*a* to be arranged apart from the back 16*d* of the fixed side contact 16.

The fixed side reinforcement plate 28 has a shape which is plate-shaped, is not provided with a level difference, and is flat washer-shaped. In this Embodiment 5, a level difference is formed by providing the fixed side projection portion 27 in the central portion on the back side of the fixed side contact 16, a portion in which the fixed side projection portion 27 comes in contact with the fixed side reinforcement plate 28 becomes a diameter D3, and effects regarding the improvement in interruption performance and the reinforcement of the fixed side contact 16 in the aforementioned Embodiment 1 can also be similarly obtained.

According to Embodiment 5 of the present invention, the shape of the fixed side reinforcement plate 28 becomes simple and can be manufactured inexpensively by press working or the like. The level difference needs to be formed by providing the fixed side projection portion 27 in the central portion on the back side of the fixed side contact 16; however, since the fixed side contact 16 is generally manufactured by machining from the beginning, an increase in cost by the addition of the level difference is small and there is an advantage that can be manufactured inexpensively as a whole.

Furthermore, a structure in which a spacer 18 is integrated with the fixed side reinforcement plate 28 in this FIG. 8 can also reduce the number of components and becomes an effective means and effects similar to those of the above-mentioned respective embodiments can be obtained.

In the aforementioned Embodiment 2 to Embodiment 5, the fixed side contact 16 side are mainly described; however, although not shown in the drawings, the movable side contact 17 side can be similarly applied and the similar effects can be exhibited.

Incidentally, the present invention can freely combine the respective embodiments and appropriately modify and/or omit the respective embodiments, within the scope of the present invention.

INDUSTRIAL APPLICABILITY

The present invention is suitable for achieving a vacuum interrupter which can improve interruption performance of the vacuum interrupter while maintaining the strength of a contact portion.

DESCRIPTION OF REFERENCE NUMERALS

10 Vacuum vessel, 13 Fixed side electrode rod, 14 Movable side electrode rod, 16 Fixed side contact, 16*a* Contact portion, 16*c* Groove, 16*d* Back, 17 Movable side contact, 17*a* Contact portion, 17*c* Groove, 17*d* Back, 18 Spacer, 19 Fixed side reinforcement plate, 19*a* Step portion, 20 Spacer, 21 Movable side reinforcement plate, 21*a* Step portion, 23 Fixed side reinforcement plate, 23*a* Step portion, 24 Fixed side reinforcement plate, 24*a* Step portion, 25 Fixed side reinforcement plate, 25*a* Step portion, 26*a* Spacer, 27 Fixed side projection portion, 28 Fixed side reinforcement plate, 28*a* Step portion

The invention claimed is:

1. A vacuum interrupter comprising:

a fixed side contact and a movable side contact, each of which is arranged in a vacuum vessel to be able to connect and disconnect, has a contact portion to be connected to and disconnected from each other, and is formed with a plurality of arc shaped grooves from a center portion to a rim portion;

a fixed side electrode rod connected to said fixed side contact;

a movable side electrode rod connected to said movable side contact;

a fixed side reinforcement plate which is arranged between said fixed side electrode rod and said fixed side contact, and a rim portion of the fixed side reinforcement plate has a step portion to be arranged apart from a back of said fixed side contact; and a movable side reinforcement plate which is arranged between said movable side electrode rod and said movable side contact, and a rim portion of the movable side reinforcement plate has a step portion to be arranged apart from a back of said movable side contact, wherein the step portion of the fixed side reinforcement plate does not come in contact with the fixed side contact in an area on an outer side relative to a portion in which the fixed side reinforcement plate comes in contact with the fixed side contact, and the step portion of the movable side reinforcement plate does not come in contact with the movable side contact in an area on an outer side relative to a portion in which the movable side reinforcement plate comes in contact with the movable side contact, wherein a diameter of a portion in which said fixed side reinforcement plate comes in contact with said fixed side contact and a diameter of a portion in which said movable side reinforcement plate comes in contact with said movable side contact are set to D3, a diameter of said fixed side contact and a diameter of said movable side contact are set to D2, and an inner diameter of a thick portion of the rim portion of said fixed side contact and an inner diameter of a thick portion of the rim portion of said movable side contact are set to D1, D1 is smaller than D3 and D3 is smaller than D2 (D1<D3<D2).

2. The vacuum interrupter according to claim 1, wherein the step portion of said fixed side reinforcement plate is arranged apart from the back of said fixed side contact by thickening a thickness of a central portion of said fixed side reinforcement plate; and the step portion of said movable side reinforcement plate is arranged apart from the back of said movable side contact by thickening a thickness of a central portion of said movable side reinforcement plate.

3. The vacuum interrupter according to claim 2, wherein a gap between the step portion of said fixed side reinforcement plate and said fixed side contact and a gap between the step portion of said movable side reinforcement plate and said movable side contact are equal to or more than 0.5 mm.

4. The vacuum interrupter according to claim 2, wherein said fixed side reinforcement plate and said movable side reinforcement plate are made of stainless steel material.

5. The vacuum interrupter according to claim 2, wherein said fixed side contact and said movable side contact are made of Cu—Cr based material containing from 20 to 60 wt % Cr.

6. The vacuum interrupter according to claim 1, wherein the step portion of said fixed side reinforcement plate is arranged apart from the back of said fixed side contact by forming a central portion of said fixed side reinforcement plate into a concave shaped portion to serve as a portion in which said fixed side reinforcement plate comes in contact with said fixed side contact; and the step portion of said movable side reinforcement plate is arranged apart from the back of said movable side contact by forming a central portion of said movable side reinforcement plate into a concave shaped portion to serve as a portion in which said movable side reinforcement plate comes in contact with said movable side contact.

7. The vacuum interrupter according to claim 6, wherein a gap between the step portion of said fixed side reinforcement plate and said fixed side contact and a gap between the step portion of said movable side reinforcement plate and said movable side contact are equal to or more than 0.5 mm.

8. The vacuum interrupter according to claim 6, wherein said fixed side reinforcement plate and said movable side reinforcement plate are made of stainless steel material.

9. The vacuum interrupter according to claim 6, wherein said fixed side contact and said movable side contact are made of Cu—Cr based material containing from 20 to 60 wt % Cr.

10. The vacuum interrupter according to claim 1, wherein a gap between the step portion of said fixed side reinforcement plate and said fixed side contact and a gap between the step portion of said movable side reinforcement plate and said movable side contact are equal to or more than 0.5 mm.

11. The vacuum interrupter according to claim 1, wherein said fixed side reinforcement plate and said movable side reinforcement plate are made of stainless steel material.

12. The vacuum interrupter according to claim 1, wherein said fixed side contact and said movable side contact are made of Cu—Cr based material containing from 20 to 60 wt % Cr.

13. A vacuum interrupter comprising:

a fixed side contact and a movable side contact, each of which is arranged in a vacuum vessel to be able to connect and disconnect, has a contact portion to be connected to and disconnected from each other, and is formed with a plurality of arc shaped grooves from a center portion to a rim portion;

a fixed side electrode rod connected to said fixed side contact;

a movable side electrode rod connected to said movable side contact;

a fixed side reinforcement plate which is arranged between said fixed side electrode rod and said fixed side contact, and a rim portion has a step portion to be arranged apart from a back of said fixed side contact; and a movable side reinforcement plate which is arranged between said movable side electrode rod and said movable side contact, and a rim portion has a step portion to be arranged apart from a back of said movable side contact, wherein the step portion of said fixed side reinforcement plate is arranged apart from the back of said fixed side contact by arranging a first spacer having a first rim portion, the first rim portion formed with a step portion between said fixed side electrode rod and said fixed side contact, and by attaching said fixed side reinforcement plate on the step portion of said first spacer; and the step portion of said movable side reinforcement plate is arranged apart from the back of said movable side contact by arranging a second spacer having a second rim portion, the second rim portion formed with a step portion between said movable side electrode rod and said movable side contact, and by attaching said movable side reinforcement plate on the step portion of said second spacer.

14. The vacuum interrupter according to claim 13, wherein said fixed side reinforcement plate and said first spacer are made as an integrated structure; and said movable side reinforcement plate and said second spacer are made as an integrated structure.

15. The vacuum interrupter according to claim 13, wherein a gap between the step portion of said fixed side reinforcement plate and said fixed side contact and a gap between the step portion of said movable side reinforcement plate and said movable side contact are equal to or more than 0.5 mm.

16. The vacuum interrupter according to claim 13, wherein said fixed side reinforcement plate and said movable side reinforcement plate are made of stainless steel material.

17. The vacuum interrupter according to claim 13, wherein said fixed side contact and said movable side contact are made of Cu—Cr based material containing from 20 to 60 wt % Cr.

18. A vacuum interrupter comprising:

a fixed side contact and a movable side contact, each of which is arranged in a vacuum vessel to be able to connect and disconnect, has a contact portion to be connected to and disconnected from each other, and is formed with a plurality of arc shaped grooves from a center portion to a rim portion;

a fixed side electrode rod connected to said fixed side contact;

a movable side electrode rod connected to said movable side contact;

a fixed side projection portion provided in a central portion on a back side of said fixed side contact;

a movable side projection portion provided in a central portion on a back side of said movable side contact;

a fixed side reinforcement plate which is arranged between said fixed side electrode rod and said fixed side contact, a central portion of the fixed side reinforcement plate comes in contact with said fixed side projection portion, and including a first rim portion having a portion to be arranged apart from the back of said fixed side contact; and a movable side reinforcement plate which is arranged between said movable side electrode rod and said movable side contact, a central portion of the movable side reinforcement plate comes in contact with said movable side projection portion, and including a second rim portion having a portion to be arranged apart from the back of said movable side contact, wherein a diameter of a portion in which said fixed side reinforcement plate comes in contact with said fixed side contact and a diameter of a portion in which said movable side reinforcement plate comes in contact with said movable side contact are set to D3, a diameter of said fixed side contact and a diameter of said movable side contact are set to D2, and an inner diameter of a thick portion of the rim portion of said fixed side contact and an inner diameter of a thick portion of the rim portion of said movable side contact are set to D1, D1 is smaller than D3 and D3 is smaller than D2 (D1<D3<D2).

19. The vacuum interrupter according to claim 18, wherein the fixed side reinforcement plate is a flat washer-shaped, and the movable side reinforcement plate is a flat washer-shaped.

* * * * *